US009010664B2

(12) United States Patent
Combs et al.

(10) Patent No.: US 9,010,664 B2
(45) Date of Patent: Apr. 21, 2015

(54) ADJUSTABLE SMOOTH BORE NOZZLE

(71) Applicant: Elkhart Brass Manufacturing Company, Inc., Elkhart, IN (US)

(72) Inventors: Eric N. Combs, Goshen, IN (US); Todd B. Lozier, Elkhart, IN (US)

(73) Assignee: Elkhart Brass Manufacturing Company, Inc., Elkhart, IN (US)

( * ) Notice: Subject to any disclaimer, the term of this patent is extended or adjusted under 35 U.S.C. 154(b) by 0 days.

(21) Appl. No.: 14/012,277

(22) Filed: Aug. 28, 2013

(65) Prior Publication Data

US 2013/0341432 A1 Dec. 26, 2013

Related U.S. Application Data

(63) Continuation of application No. 13/653,107, filed on Oct. 16, 2012, now abandoned, which is a continuation of application No. 13/149,242, filed on May 31, 2011, now abandoned, which is a continuation of application No. 11/894,089, filed on Aug. 20, 2007, now Pat. No. 7,971,800, which is a continuation of application No. 11/036,621, filed on Jan. 14, 2005, now Pat. No. 7,258,285.

(51) Int. Cl.

| | |
|---|---|
| ***A62C 31/00*** | (2006.01) |
| ***B05B 1/30*** | (2006.01) |
| ***A62C 31/03*** | (2006.01) |
| ***B05B 1/32*** | (2006.01) |
| ***A62C 31/02*** | (2006.01) |

(52) U.S. Cl.

CPC . *B05B 1/30* (2013.01); *A62C 31/03* (2013.01); *B05B 1/32* (2013.01); *A62C 31/02* (2013.01); *Y10S 239/12* (2013.01)

(58) Field of Classification Search

USPC ..... 239/436–439, 451, 452, 455–458, 239/533.1, 533.13, 537–541, 546, 576, 239/581.1, 581.2, 602, DIG. 12

See application file for complete search history.

(56) References Cited

U.S. PATENT DOCUMENTS

| | | | | |
|---|---|---|---|---|
| 22,819 | A | | 2/1859 | Parrott et al. |
| 157,526 | A | * | 12/1874 | Leggett ..... 239/455 |
| 157,527 | A | * | 12/1874 | Leggett ..... 239/455 |
| 186,310 | A | | 1/1877 | Curtis |
| 351,968 | A | | 11/1886 | Derrick |
| 583,135 | A | | 5/1897 | Wilson |
| 690,754 | A | | 1/1902 | McKechney |
| 851,603 | A | | 4/1907 | Long |
| 930,095 | A | | 8/1909 | Seagrave |
| 1,004,770 | A | | 10/1911 | Galloway |
| 1,040,899 | A | | 10/1912 | Dahmen |
| 1,072,951 | A | | 9/1913 | Johnston |
| 1,865,012 | A | | 6/1932 | Jackson |
| 2,303,992 | A | | 12/1942 | Frazier et al. |
| 2,569,996 | A | | 10/1951 | Kollsman |
| 2,585,509 | A | | 2/1952 | Smith |
| 2,959,359 | A | | 11/1960 | Casaletto |
| 3,018,792 | A | | 1/1962 | Brucker |
| 3,301,492 | A | | 1/1967 | Kingsley |
| 3,684,192 | A | | 8/1972 | McMillan |

(Continued)

*Primary Examiner* — Steven J Ganey

(74) *Attorney, Agent, or Firm* — Faegre Baker Daniels LLP

(57) ABSTRACT

An adjustable nozzle comprising a nozzle body with an inlet, an outlet, and a passageway having a smooth bore extending between the inlet and the outlet. The passageway has an inner dimension transverse to the central axis of the nozzle and a compressible wall wherein the inner dimension is adjustable to adjust the flow rate through the nozzle.

20 Claims, 10 Drawing Sheets

(56) References Cited

U.S. PATENT DOCUMENTS

| | | | |
|---|---|---|---|
| 3,776,470 | A | 12/1973 | Tsuchiya |
| 4,172,559 | A | 10/1979 | Allenbaugh, Jr. |
| 4,789,104 | A | 12/1988 | Anderson |
| 5,215,254 | A | 6/1993 | Haruch |
| 5,312,048 | A | 5/1994 | Steingass et al. |
| 5,390,696 | A | 2/1995 | Bird et al. |
| 5,964,410 | A | 10/1999 | Brown et al. |
| 6,318,706 | B1 | 11/2001 | Montaz |
| 6,598,810 | B2 | 7/2003 | Lanteri |
| 7,097,120 | B2 | 8/2006 | Marino |
| 7,445,166 | B2 | 11/2008 | Williams |
| 7,971,800 | B2 | 7/2011 | Combs et al. |
| 2003/0127541 | A1 | 7/2003 | Marino |
| 2005/0017095 | A1 | 1/2005 | Mehr |

* cited by examiner

ADJUSTABLE SMOOTH BORE NOZZLE

CROSS-REFERENCE TO RELATED APPLICATIONS

This application is a continuation application of pending U.S. patent application Ser. No. 13/653,107 filed Oct. 16, 2012, entitled ADJUSTABLE SMOOTH BORE NOZZLE, which is a continuation application of abandoned U.S. patent application Ser. No. 13/149,242 filed May 31, 2011, entitled ADJUSTABLE SMOOTH BORE NOZZLE, which is a continuation application of U.S. patent application Ser. No. 11/894,089 filed Aug. 20, 2007, granted Jul. 5, 2011 as U.S. Pat. No. 7,971,800 entitled ADJUSTABLE SMOOTH BORE NOZZLE, which is a continuation application of U.S. patent application Ser. No. 11/036,621 filed Jan. 14, 2005, granted Aug. 21, 2007 as U.S. Pat. No. 7,258,285 entitled ADJUSTABLE SMOOTH BORE NOZZLE, the entire disclosures of which are hereby expressly incorporated herein by reference.

TECHNICAL FIELD AND BACKGROUND OF THE INVENTION

The present invention generally relates to a nozzle and, more particularly, to a nozzle that has an adjustable smooth bore.

Smooth bore nozzles are well known in the art and are configured with a gradually diminishing inner diameter from their input end to their discharge or output end to increase fluid flow from a fire hose on which the nozzle is mounted. One disadvantage to smooth bore nozzles is that they have a fixed diameter. As a result, they provide a limited flow rate range, with the fluid pressure driving the flow rate change. For example, a one inch diameter smooth bore nozzle will flow approximately 184 gallons per minute at approximately a 50 psi discharge pressure. However, if the fire hose discharge pressure is increased to 70 psi, the flow rate will increase to approximately 247 gallons per minute.

Heretofore, in order to change the flow rate from a fire hose, the smooth bore nozzle is either replaced with a smooth bore nozzle with a different diameter or a fitting or tip is added to or removed from the nozzle to change in the inner diameter of the nozzle. For example, when a one inch diameter smooth bore nozzle is substituted with a 1.25 inch diameter smooth bore nozzle, the flow will increase to approximately 326 gallons per minute with the same 50 psi discharge pressure. Or as noted, it has also been common practice to have smooth bore nozzles with multiple fittings or tips with each fitting or tip having a different diameter. Each fitting is threaded onto the nozzle to adjust the inner diameter of the nozzle. However, in either case this requires the user to shut off the water supply when changing the nozzle or adding or removing a fitting to change the nozzle diameter. As a result, this can create downtime for the firefighter.

Accordingly, there is a need for a smooth bore nozzle whose flow rate can be adjusted without having to shut off the water flow.

SUMMARY OF THE INVENTION

Accordingly, the present invention provides a nozzle that has an adjustable bore and, therefore, can vary the flow rate through the nozzle without requiring the flow to be shut off In other words, the present invention provides a nozzle that is adapted to have its bore diameter adjusted while still in a flow condition.

In one form of the invention, an adjustable nozzle includes a nozzle body, with an inlet and an outlet, and a passageway with a smooth bore extending between the inlet and the outlet. The inlet is adapted for coupling to a fire suppressant source, such as a fire hose or a pipe. The passageway has an inner dimension transverse to the central axis and a flexible wall wherein the inner dimension is adjustable to adjust the flow rate through the nozzle.

In one aspect, the flexible wall comprises a flexible membrane, such as a thin flexible rubber membrane that forms a bladder.

In another aspect, the nozzle further includes a nozzle coupler for mounting the nozzle to the fire suppressant supply. The hose coupler may be used to secure at least one end of the flexible membrane to the nozzle body.

In yet another aspect, the nozzle further includes a tip that is mounted to the nozzle body. The tip adjusts the inner dimension of the passageway to thereby adjust the flow rate through the nozzle. In a further aspect, the tip is movably mounted, such as by threads or a cam slot, onto the nozzle body and has a tapered interface with the flexible wall wherein the tip compresses the flexible wall when the tip is retracted onto the nozzle body. For example, the flexible wall may comprise a plurality of spaced beams, with the beams extending along the central axis and flexing inwardly when compressed by the tip to thereby reduce the inner dimension of the passageway. In a preferred form, the beams comprise cantilevered beams and are cantilevered from the first body portion. In yet another aspect, each of the beams includes a ramped surface, such as a wedge-shaped end, with the tip contacting the ramped surfaces and compressing the beams when the tip is retracted on the first body portion.

According to another form of the invention, an adjustable nozzle includes a nozzle body having a longitudinal central axis, a first body portion, and a second body portion in fluid communication with the first body portion. The first body portion forms an inlet and has a fixed inner diameter. The second body portion forms an outlet and has a flexible membrane with an inner dimension. A nozzle coupler is mounted to the nozzle body for mounting the nozzle body to a fire suppressant source, such as a fire hose or a pipe. A tip is mounted to the nozzle body at the first body portion and extends along the second body portion and is spaced from the second body portion over at least a portion of the second body portion.

In one aspect, the nozzle includes a compressible wall between the membrane and the tip. For example, the compressible wall may comprise a wall with a plurality of spaced longitudinal slots extending along the central axis. The flexible membrane, which extends from the inlet to the outlet, defines a flexible bladder and an inner surface of the second body portion. In addition, the coupler preferably secures the flexible membrane to the nozzle body.

In another aspect, the tip comprises a conical-shaped tip that is tapered from the first body portion to the outlet. The tip mounts onto the first body portion on one end and contacts the flexible wall with an opposed end and compresses the flexible wall when retracted onto the first body portion. For example, the tip may include an inwardly projecting shoulder at the opposed end that contacts the flexible wall and compresses the flexible wall when the tip is retracted onto the first body portion. For example, the shoulder may have a tapered interface with the flexible wall.

In a further aspect, the flexible wall comprises a plurality of spaced beams that extend along the central axis and flex inwardly when compressed by the shoulder to thereby reduce the inner dimension of the passageway. For example, the beams may comprise cantilevered beams that are cantilevered from the first body portion. In addition, each of the beams includes a ramped surface, such as a wedge-shaped end, with the shoulder contacting the ramped surfaces and compressing the beams when the tip is retracted onto the first body portion.

In another aspect, the tip includes an inner surface, with the flexible bladder expandable up to the inner surface of the tip in response to increased pressure in the passageway wherein the inner dimension of the flexible membrane increases to thereby increase the flow rate through the nozzle.

According to yet another form of the invention, an adjustable nozzle includes a nozzle body having a longitudinal central axis, a first body portion, and a compressible second body portion in fluid communication with the first body portion. The first body portion forms an inlet and has a fixed inner diameter. The second body portion forms an outlet and has a flexible inner diameter. A nozzle coupler is mounted to the nozzle body for mounting the nozzle body to a fire hose. In addition, the nozzle includes a tip that is mounted to the nozzle body at the first body portion and that extends along the second body portion over at least a portion of the second body portion. The tip is threaded on the nozzle body and is adjustable along the longitudinal axis and contacts a portion of the second body portion with a tapered interface wherein the tip compresses the second body portion at the tapered interface when the tip is retracted onto the nozzle body to thereby reduce the inner diameter of the second body portion. In addition, the nozzle includes a flexible membrane that forms a bladder that has an inner diameter and an outer diameter, which is less than the inner diameter of the compressible, second body portion when in an unpressurized configuration and when the second body portion is uncompressed but expands to a pressurized configuration in response to fluid pressure in the passageway. When in the pressurized configuration, the bladder is compressible and able to maintain its smooth inner surface to provide the nozzle with an adjustable smooth bore In one aspect, the second body portion may comprise a flexible wall. For example, the flexible wall may comprise a wall with a plurality of spaced longitudinal slots extending along the central axis. In addition, the nozzle may extend from the inlet to the outlet to define the inner surface of the nozzle body.

According to a further aspect, the tip comprises a conical-shaped tip tapered from the first body portion to the outlet and is threaded onto the first body portion on one end and contacts the second body portion with an opposed end. When retracted onto the first body portion, the tip compresses the second body portion.

Accordingly, the present invention provides a smooth bore nozzle with an adjustable diameter so that the flow rate through the nozzle can be achieved during a flow condition.

These and other objects, advantages, purposes, and features of the invention will become more apparent from the study of the following description taken in conjunction with the drawings.

DETAILED DESCRIPTION OF THE DRAWINGS

DETAILED DESCRIPTION OF THE PREFERRED EMBODIMENTS

Figure 1:
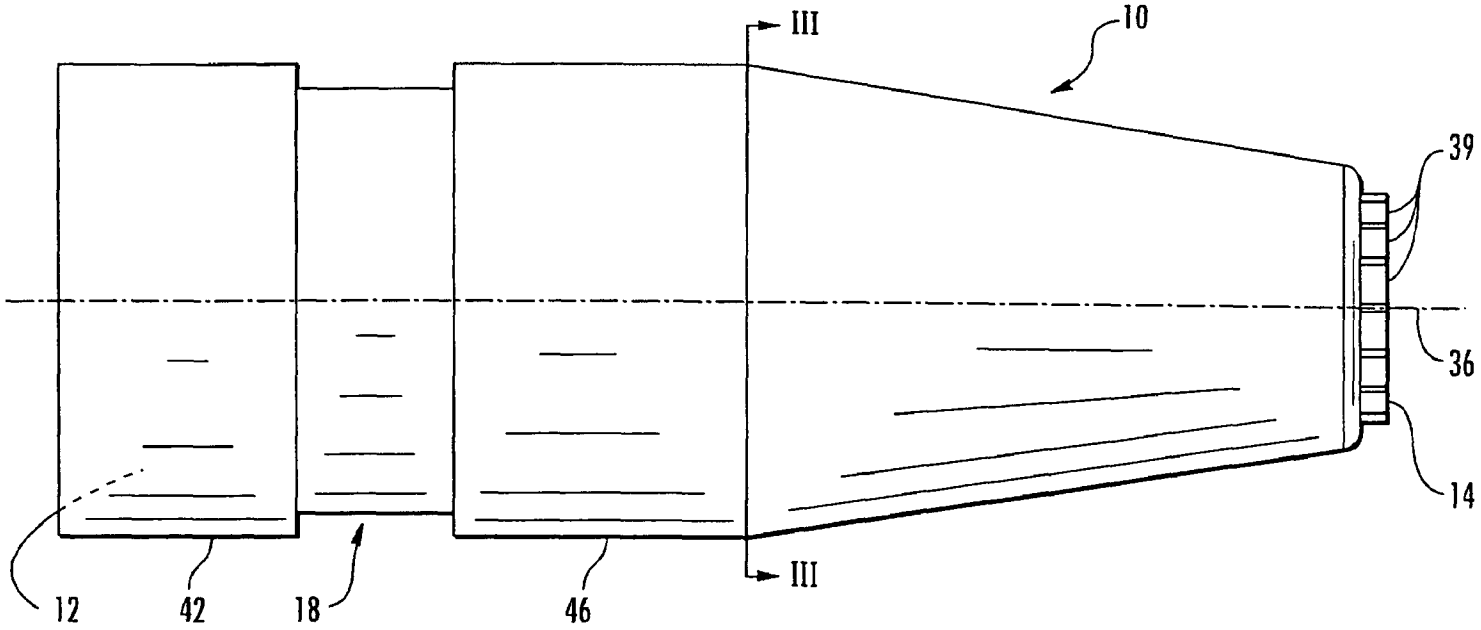
FIG. 1 is a side view of a nozzle of the present invention.
Figure 2:
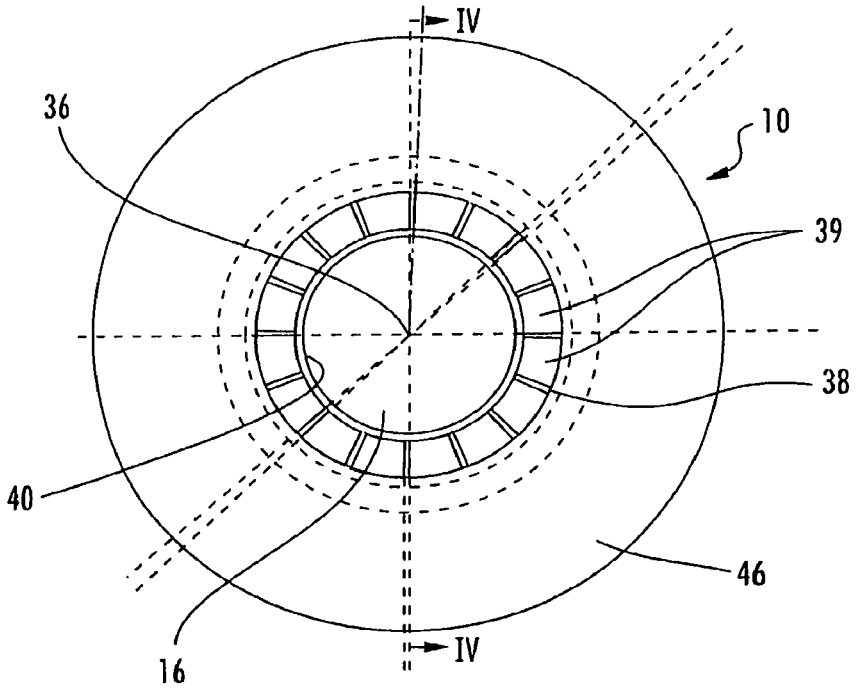
FIG. 2 is an end view of the nozzle of FIG. 1.

Referring to FIG. 1, the numeral 10 generally designates a nozzle of the present invention. As will be more fully described below, in the illustrated embodiment, nozzle 10 comprises a master stream nozzle that is suitable for mounting on a monitor and is configured to provide an adjustable smooth bore that can be adjusted while the fluid is still flowing from the monitor and through the nozzle. However, it should be understood that nozzle 10 may comprise a handline nozzle or a pipe nozzle.

Figure 4:
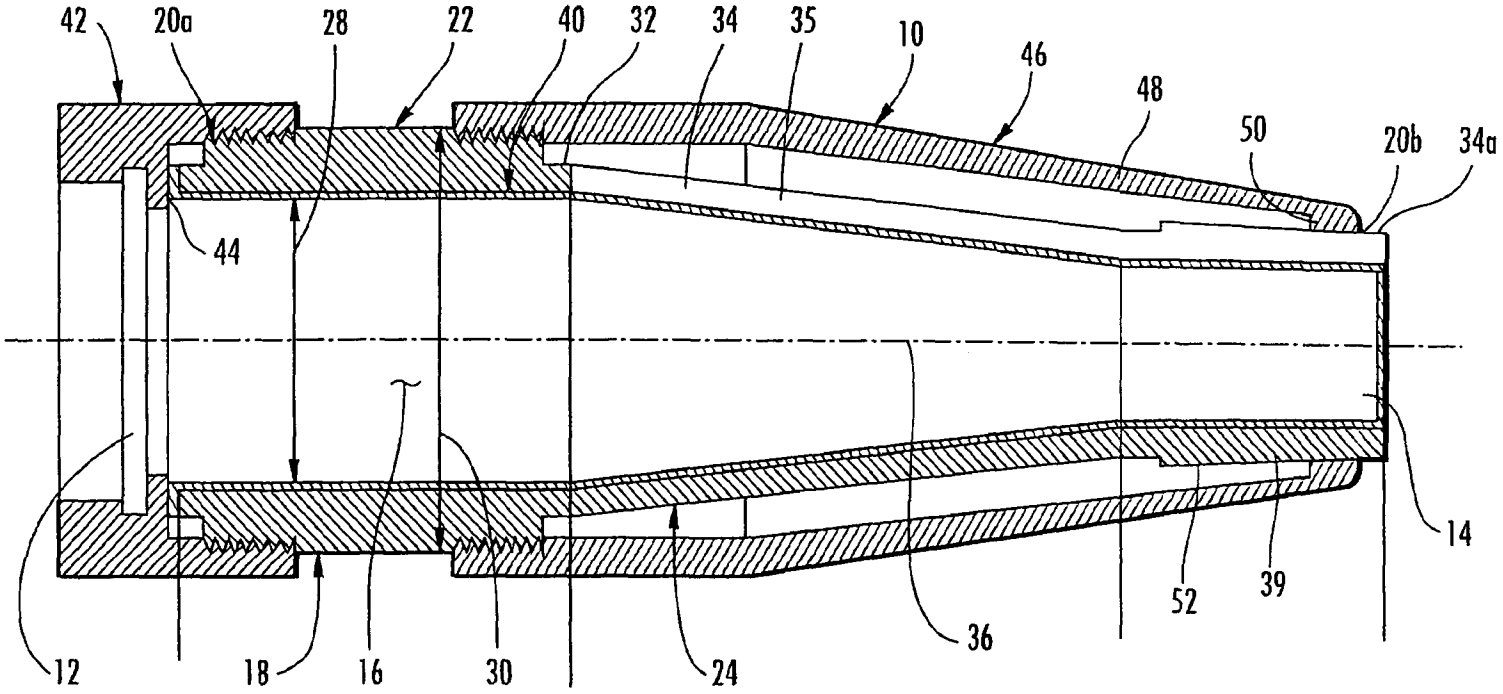
FIG. 4 is a cross-section view taken along line IV-IV of FIG. 2.

Referring to FIG. 4, nozzle 10 includes an inlet 12, an outlet 14, and a passageway 16 that extends from inlet 12 to outlet 14. As detailed below, nozzle 10 includes a flexible or compressible wall whose inner dimension transverse to the nozzle's central axis 36, such as its inner diameter, is adjustable to adjust the flow rate through the nozzle.

Nozzle 10 includes a nozzle body 18 with a first end 20*a* forming inlet 12 and an opposed second end 20*b* forming outlet 14. Nozzle body 18 is preferably formed from a rigid, but ductile material, such as a plastic or metal. For example, a suitable metal may include aluminum or brass. Nozzle body 18 includes a first or cylindrical body portion 22 and a second or tapered body portion 24 that extends from cylindrical body portion 22. In the illustrated embodiment, second body portion 24 is integrally formed with cylindrical body portion 22. However, it should be understood that they may be separately formed, as will be more fully described below in reference to nozzle 210. Further, they may be formed from different materials.

Figure 3:
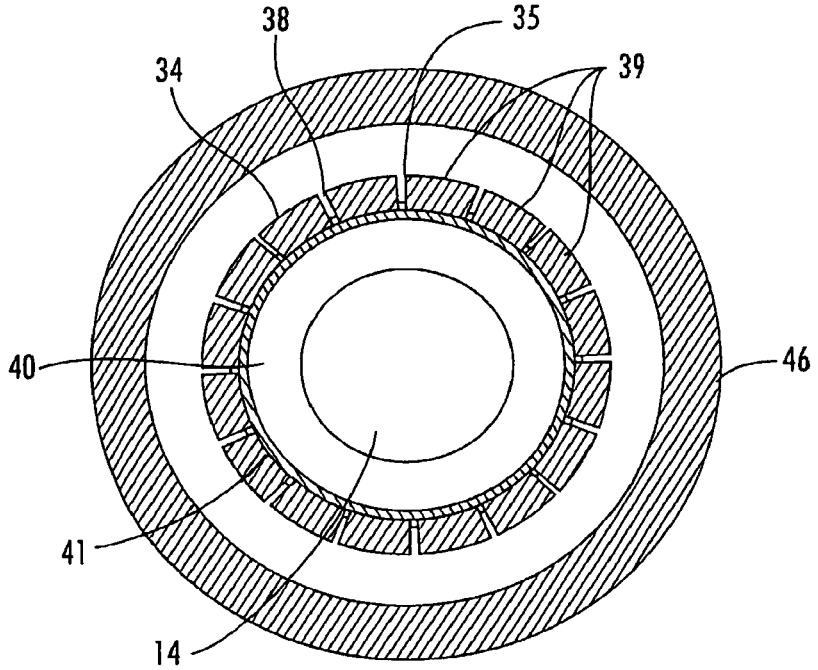
FIG. 3 is a cross-section view taken along line III-III of FIG. 1.

First cylindrical body portion 22 is formed from a fixed cylindrical wall with a fixed inner diameter 28 and a fixed outer diameter 30. Tapered body portion 24 is formed from a generally conical-shaped wall that includes a base wall 32 that is connected to cylindrical body portion 22 and a tapered wall 34 with a plurality of spaced slots 35 (FIG. 3) that extend from the distal end 34*a* of tapered wall 34 to base wall 32 to form a compressible tapered wall that is compressible inwardly over at least a portion of its length to vary the inner diameter of tapered portion 24. Accordingly, when the compressible tapered wall is compressed inwardly, the inner diameter of tapered portion 24 is adjusted, which adjusts the flow rate through the nozzle and the flow rate of the discharge from outlet 14, as will be more fully described below.

Preferably, slots 35 are aligned and generally parallel to the center line or central axis 36 of nozzle 10 and are formed, such as by machining, so that they extend through the entire thickness of tapered wall 34 to thereby create gaps 38 in wall 34. As noted above, these slots (35) extend from distal end 34*a* of wall 34 to adjacent base wall 32 so that they form "fingers" or cantilevered beams 39 in tapered portion 24 that extend and are cantilevered from body portion 22. Fingers or beams 39 are, therefore, flexible and act like springs that can be deflected inwardly to reduce the effective inner diameter of tapered portion 24.

To form a smooth bore in passageway 16, nozzle body 18 includes a flexible membrane 40, such as a rubber membrane, that forms a flexible bladder and extends from inlet 12 to outlet 14. Membrane 40 is attached, such as by molding, to the nozzle body at the largest diameter portion of body portion 22 at is proximal end 40*a*. The distal end 40*b* of membrane 40 is extended through the tapered body portion 24. Tapered body portion 24 is sized, such as by machining, to a diameter that is greater than the outer diameter of membrane 40 in its unpressurized, unexpanded configuration to thereby form a chamber between membrane 40 and tapered body portion 24 when membrane 40 is not pressurized. When membrane 40 is pressurized, membrane 40 will expand to an expanded configuration until its outer diameter is equal to the inner diameter of tapered body portion 24 when it reaches the inner surface of tapered body portion 24. In this manner, when tapered body portion 24 is compressed inwardly, membrane 40 will return to a less expanded configuration, which allows membrane 40 to maintain its smooth walled configuration and, hence, smooth bore, and prevents membrane 40 from forming folds or ripples in its wall when compressed. In addition, membrane 40 is preferably sufficiently rigid to hold its shape but flexible enough to deflect in response to beams 39 being compressed inwardly. Further, the tension in membrane 40 preferably does not allow the membrane to extrude into the gaps (38) formed between beams 39. As a result, membrane 40 forms a smooth bore through nozzle 10 that is flexible to allow the inner diameter to be adjusted to adjust the fluid velocity through the nozzle.

The thickness of membrane 40 will vary greatly depending on the size of the nozzle and the membrane material. For example, a suitable thickness for a rubber membrane for a 1¼ inch to 1 inch nozzle may fall in a range of $60/1000^{th}$ of an inch (or 60 mils) to $80/1000^{th}$ of an inch (or 80 mils). For larger nozzles, this thickness may be increased and fall in a range, for example, of $125/1000^{th}$ of an inch to $250/1000^{th}$ of an inch. Optionally, a metal sleeve 41 (FIG. 3) may be positioned between membrane 40 and beams 39 to assure that the membrane 40 does not extrude into the gaps. For example, sleeve 41 may comprise a thin metal sleeve that is formed from a triangular-shaped sheet that is rolled into the conical shape defined by the inner surfaces of beams 39, with the longitudinal edges of the sheet overlapping to allow the sleeve to compress or expand as needed.

To facilitate mounting of nozzle 10 to a monitor, a fire hose, or a pipe, nozzle 10 further includes a nozzle coupler or collar 42 that is threaded on the nozzle body 18. Collar 42 includes an inwardly extending radial lip 44, which is urged against the distal end of nozzle body 18 when collar 42 is threaded onto nozzle body 18 and, further, may be used to compress and, thereby, secure the end of flexible membrane 40 to nozzle body 18 at inlet 12, such as shown in FIG. 4.

To adjust the inner diameter of tapered body portion 24 of nozzle body 18, nozzle 10 further includes an adjustment tip 46. Adjustment tip 46 comprises a conical-shaped body that is mounted onto cylindrical body portion 22 of nozzle body 18. Adjustment tip 46 includes a tapered wall 48 spaced from tapered wall 34 with an inwardly extending lip or shoulder 50 that is provided at its outer end. Shoulder 50 contacts the outer ends of the tapered wall's fingers or beams (39) and forms a ramped or cam interface with beams 39. In the illustrated embodiment, each of the beams includes a ramped surface 52, such as a wedge-shaped end, that provides a contact surface for shoulder 50 of adjustment tip 46. In this manner, when adjustment tip 46 is retracted on nozzle body 18, shoulder 50 will move along ramped surfaces 52, which will cause fingers or beams 39 to compress inwardly when adjustment tip 46 is retracted onto the cylindrical body portion 22 but will allow fingers or beams 39 to expand radially outward and return to their uncompressed state when adjustment tip 46 is moved to its fully extended position, such as generally shown in FIG. 4. In this manner, the inner diameter of the bore of passageway 16 through nozzle 10 may be adjusted by simply adjusting the tip along the nozzle body. It should be understood that the slope angle of ramped surfaces 52 may be varied to increase or decrease the amount of adjustment in the inner diameter of tapered portion 24.

In the illustrated embodiment, tip 46 is threaded onto nozzle body 18; therefore, when tip 46 is rotated about nozzle body 18, tip 46 will be extended from or retracted onto nozzle body 18. Alternately, tip 46 may be guided along nozzle body 18 by a cam slot and pin arrangement, for example with the cam slot on the body and the pin on the tip. Further, tip 46 may comprise a slide tip. In addition, tip 46 may be remotely controlled. For example, nozzle 10 may incorporate a driver, such as a motor or cylinder, including a hydraulic cylinder or pneumatic cylinder, to control the position of tip 46. Further, the driver may be remotely controlled, for example, using RF technology. For examples of drivers and RF controls, reference is made herein to U.S. Pat. No. 6,994,282 filed Apr. 2, 2003 and entitled RADIO CONTROLLED LIQUID MONITOR, and U.S. Pat. No. 7,191,964 filed Nov. 9, 2004 and entitled FIRE-FIGHTING MONITOR WITH REMOTE CONTROL, all commonly owned by Elkhart Brass Manufacturing Company of Elkhart, Ind., which are incorporated herein by reference in their entireties.

Figure 5:
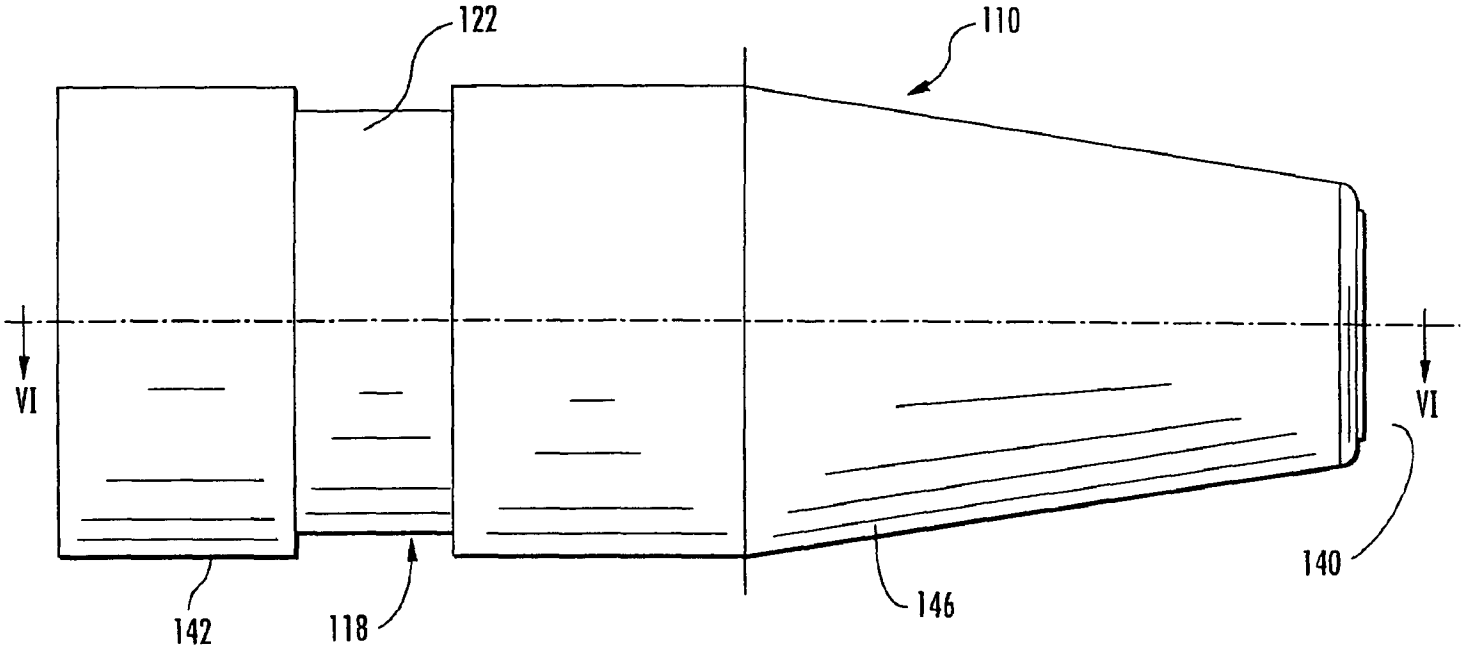
FIG. 5 is a side view of another embodiment of the nozzle of the present invention.
Figure 6:
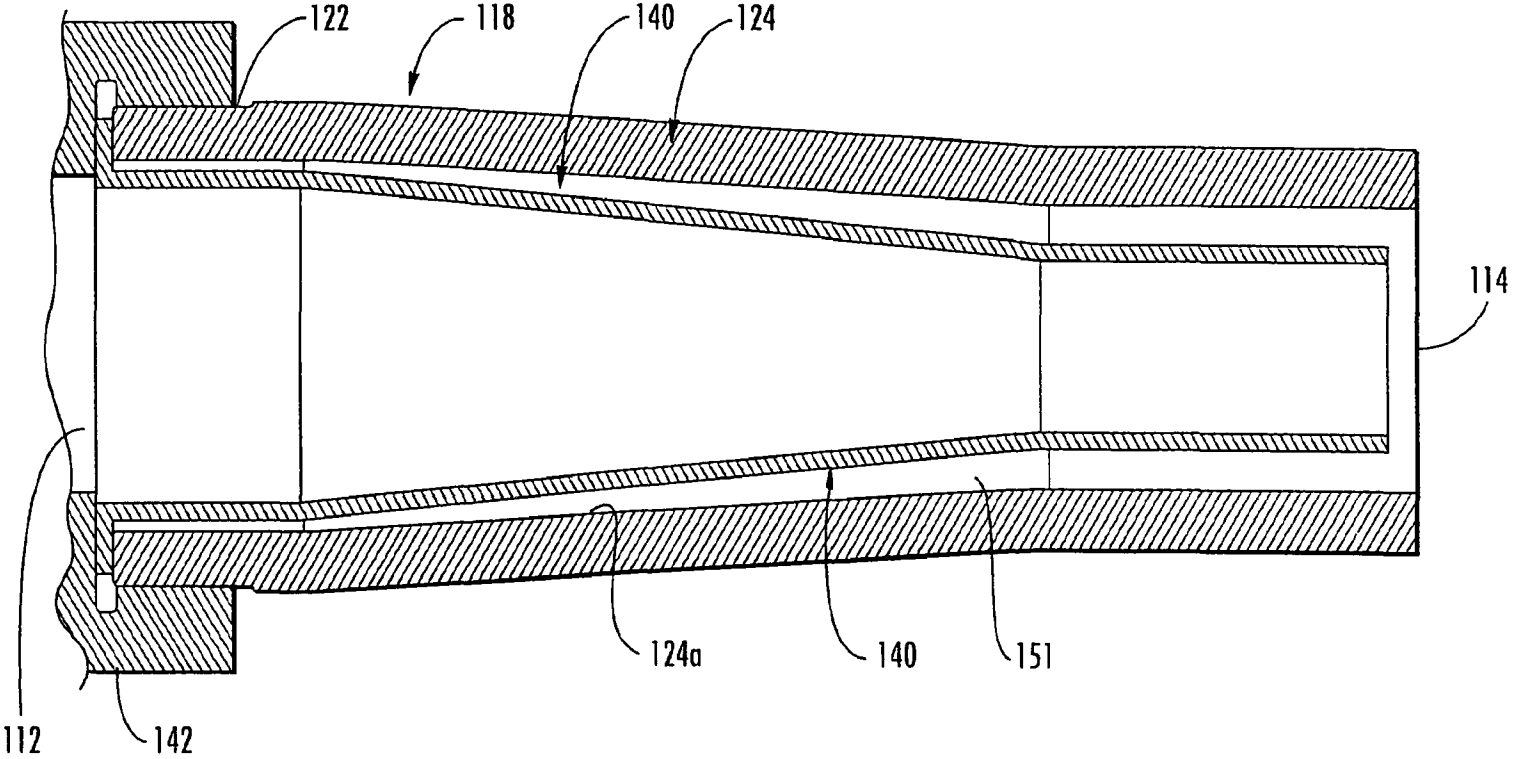
FIG. 6 is a cross-section view taken along line VI-VI of FIG. 5.
Figure 7:
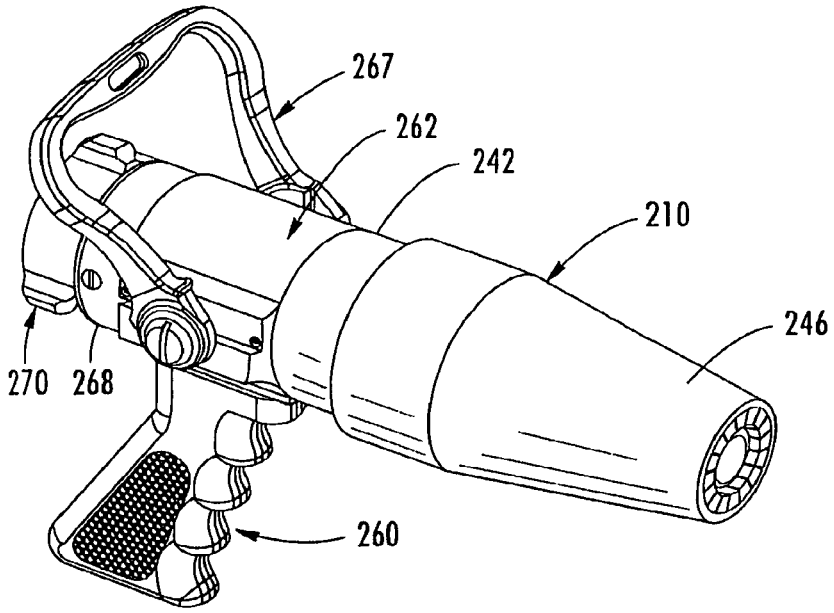
FIG. 7 is a perspective of another embodiment of the nozzle of the present invention.
Figure 8:
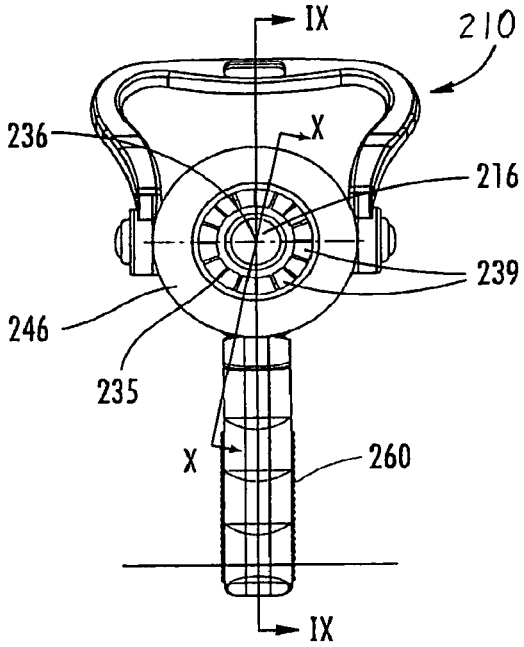
FIG. 8 is an end view of the nozzle of FIG. 7.

Referring to FIGS. 5-6, the numeral 110 generally designates another embodiment of a master flow nozzle of the present invention. Nozzle 110 similarly includes a nozzle body 118 with a first cylindrical body portion 122 and a tapered or conical body portion 124, which extends from cylindrical body portion 122. Cylindrical body portion 122 includes fixed inner and outer diameters similar to the previous embodiment and, further, is adapted to receive a collar 142 that is threaded onto a nozzle body 118 for mounting nozzle 110 to a monitor or fire hose. However, it should be understood that nozzle 110 may also be mounted to a pipe.

In the illustrated embodiment, cylindrical body portion 122 is formed from a rigid material, such as plastic or a metal, for example aluminum or brass. Tapered body portion 124 of nozzle body 118 is also formed from rigid material and, in the illustrated embodiment, is integral with cylindrical body portion 122. Positioned in nozzle body 118 is a flexible membrane 140, such as a rubber membrane, that forms a bladder and extends from inlet 112 of nozzle 110 to outlet 114. Membrane 140 is secured to nozzle body 118 in a similar manner to the previous embodiment and provides an adjustable smooth bore for nozzle 110, described below.

In the illustrated embodiment, tapered body portion 124 is solid and, hence non-compressible and has a fixed diameter. Similar to membrane 40, membrane 140 is rigid enough to hold its shape but flexible enough to expand under internal pressure. As a result, under low pressures, the diameter of membrane 140 is generally unchanged and membrane 140 is in an unexpanded or unpressurized configuration. However, the diameter of membrane 140 increases in response to an increase in the nozzle internal pressure until the bladder has expanded to the inner surface 124*a* of tapered portion 124 to match the internal diameter of tapered portion 124. The space 151 between membrane 140 and inner surface 124 of tapered portion 124*a* may or may not be pressurized. In this manner, the expansion of the bladder can be balanced or adjusted by the pressure in space 151. Optionally, tapered portion 124*a* may include a pressure relief device, for example, a pressure relief valve, that may be manually operable to release the pressure in space 151.

Referring to FIGS. 7-11, the numeral 210 generally designates another embodiment of the nozzle of the present invention. In the illustrated embodiment, nozzle 210 comprises a hand-line nozzle that incorporates a fixed handle for holding the nozzle and a pivotal handle for controlling a valve, described more fully below. Similar to nozzles 10 and 110, nozzle 210 includes a flexible membrane 240 that provides a smooth bore with an adjustable diameter to adjust the flow through the nozzle.

In addition, though equally applicable to the first two embodiments, as a result of its adjustable diameter, nozzle 210 can be adjusted to reduce the reaction forces generated by the flow of fluid through the nozzle for a given flow by reducing the diameter of the nozzle bore. The reaction forces generated by flow through a straight bore nozzle is given by the equation: $1.5 \times D^2 \times$Pressure. Therefore, for example, for a 1" diameter nozzle flowing 200 gpm the pressure is 46 psi. Hence, the reaction force is 69 lbs. If the diameter of the bore can be reduced to, for example, 1.25" with the same flow, the pressure is 20 psi. At this diameter and pressure, the resulting reaction force is 46 lbs. For a master stream nozzle, this change in reaction force typically does not have much impact because master stream nozzles are often mounted to a monitor. However, for a hand-line nozzle, which is typically held by a fire fighter, this reduction in reaction forces can make handling the nozzle easier, reducing the stress and strain on the firefighter or firefighters using the nozzle.

Figure 9:
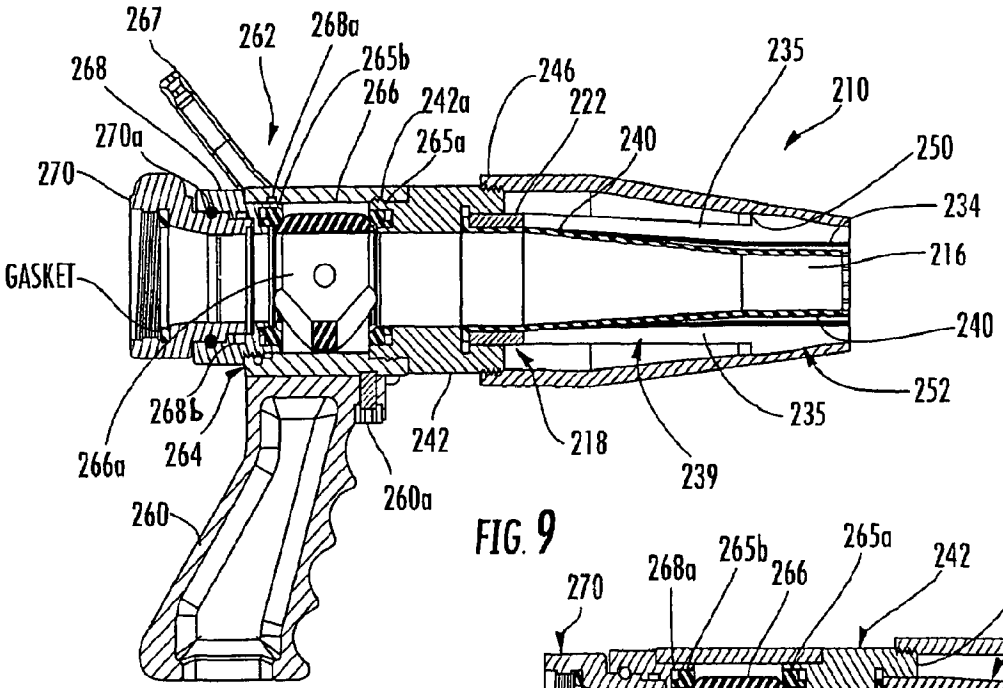
FIG. 9 is a cross-section taken along line IX-IX of FIG. 8.

As best seen in FIG. 9, nozzle 210 includes a nozzle body 218, which includes an inlet 212, an outlet 214, and a passageway 216 that extends from inlet 212 to outlet 214. Mounted to nozzle body 218 is an adapter or coupler 242 for mounting handle 260 and a valve 262 to nozzle body 218, as will be more fully described below.

Similar to the previous embodiments, nozzle body 218 includes a passageway 216 with a flexible or compressible wall (234) whose inner dimension transverse to the nozzle's central axis 236, such as its inner diameter, is adjustable to adjust the flow rate through the nozzle.

Nozzle body 218, which is preferably formed from a rigid, but ductile material similar to body 18, includes a first or cylindrical body portion 222 and a second or tapered body portion 224 that extends from cylindrical body portion 222. Second body portion 224 is integrally formed with cylindrical body portion 222; however, it should be understood that they may be separately formed, as noted above. Further, they may be formed from different materials.

First cylindrical body portion 222 has a fixed cylindrical wall with a fixed inner diameter and a fixed outer diameter. Tapered body portion 224 is formed from a generally conical-shaped wall 234 with a plurality of spaced slots 235 (FIG. 3) that extend from cylindrical portion 222 to form a compressible tapered wall 234 consisting of a plurality of cantilevered fingers or beams 239 that are compressible inwardly over at least a portion of their length to vary the inner diameter of tapered body portion 224. Accordingly, when the compressible tapered wall is compressed inwardly, the inner diameter of tapered body portion 224 is adjusted, which adjusts the flow rate through the nozzle and the flow rate of the discharge from outlet 214. Further, as noted above, for a given flow rate this reduction in diameter reduces the pressure and in turn reduces the reaction force. By the same token, if an increase in pressure is desired, the diameter of the nozzle can be reduced, which for a given flow rate will cause the pressure to increase.

Preferably, slots 235 are aligned and generally parallel to the center line or central axis 236 of nozzle 210 and are formed, such as by machining, so that they extend through the entire thickness of tapered wall 234 to thereby create gaps in wall 234. Fingers or beams 239 are, therefore, flexible and act like springs that can be deflected inwardly to reduce the effective inner diameter of tapered body portion 224.

Figure 10:
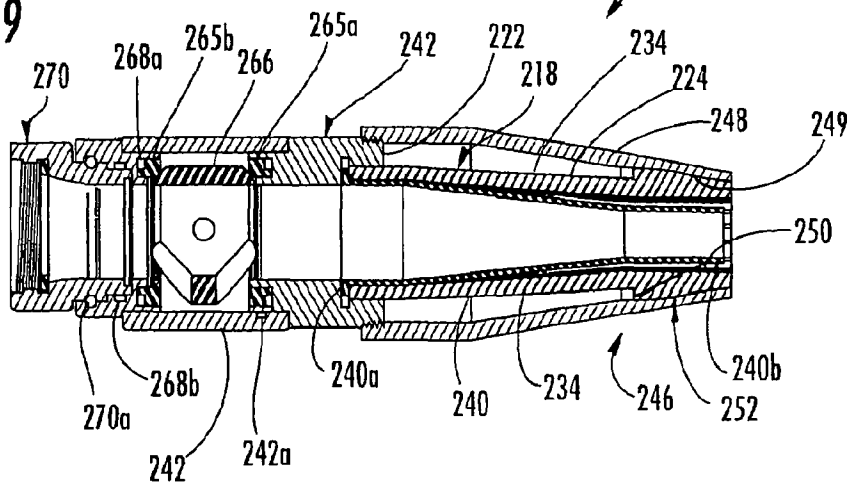
FIG. 10 is a cross-section taken along line X-X of FIG. 8.
Figure 12:
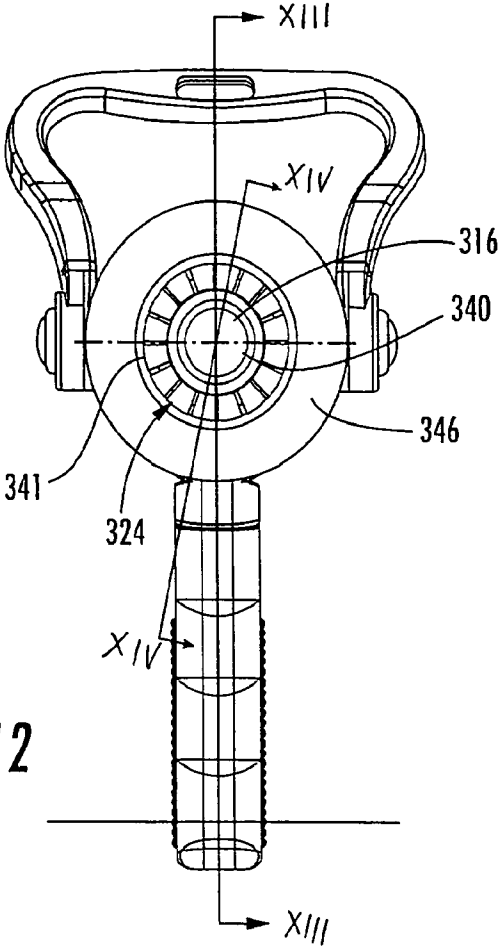
FIG. 12 is an end view of the nozzle of FIG. 11.
Figure 11:
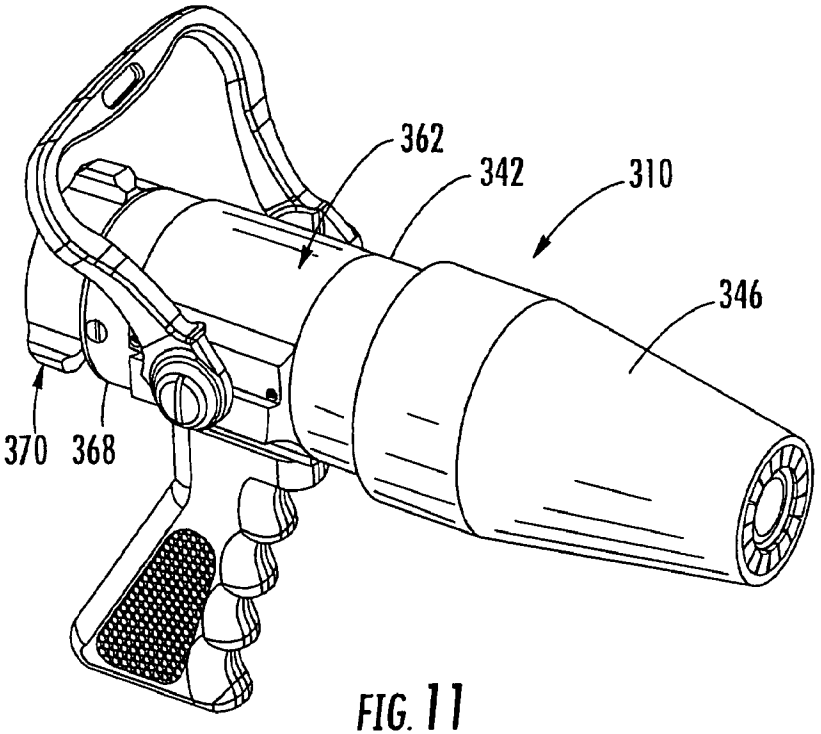
FIG. 11 is a perspective view of a fourth embodiment of the nozzle of the present invention.
Figure 13:
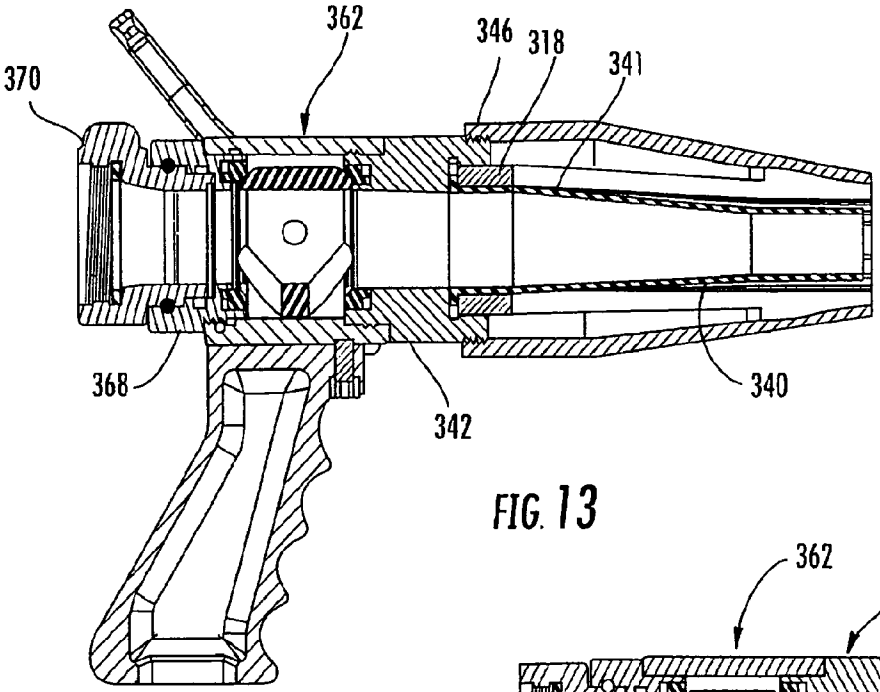
FIG. 13 is a cross-section taken along line XIII-XIII of FIG. 12.
Figure 14:
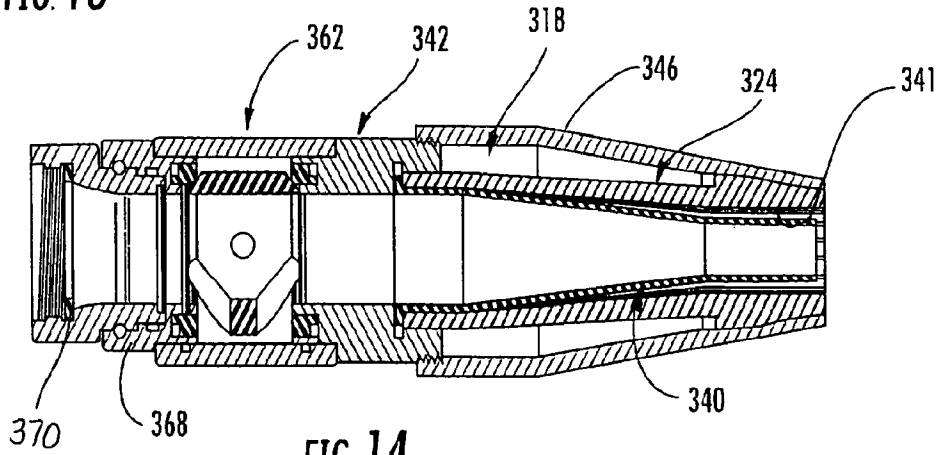
FIG. 14 is a cross-section taken along line XIV-XIV of FIG. 12.

To form a smooth bore in nozzle 210, nozzle body 218 includes a flexible membrane 240, similar to membranes 40 and 140, that extends from inlet 212 of nozzle body 218 to outlet 14 of nozzle body 218. At its proximal end 241*a*, membrane 240 is molded to the nozzle at inlet end of nozzle body 218. Distal end 240*b* of membrane 240 is extended through the tapered body portion 224. As best seen in FIG. 10, the inner diameter of tapered body portion 224 is greater than the outer diameter of membrane 240 in its unpressurized, unexpanded configuration to thereby form a gap between membrane 240 and tapered body portion 224 when membrane 240 is not pressurized in a similar manner to nozzle 10. When membrane 240 is pressurized, membrane 240 will expand to an expanded configuration until its outer diameter is equal to the inner diameter of tapered body portion 224. In this manner, when membrane 240 is in its expanded configuration and tapered body portion 224 is compressed inwardly, membrane 240 will compress and return to a less expanded configuration, which allows membrane 240 to maintain its smooth walled configuration. Further, as described in reference to the previous embodiments, the tension in membrane 240 preferably does not allow the membrane to extrude into the gaps formed between beams 239. As a result, membrane 240 forms a smooth bore through nozzle 10 that is flexible to allow the inner diameter to be adjusted to adjust the fluid velocity through the nozzle.

Optionally, a metal sleeve may be positioned between membrane 240 and beams 239 to assure that the membrane 240 does not extrude into the gaps, as described in reference to nozzle 10.

To adjust the inner diameter of tapered body portion 224 of nozzle body 218, nozzle 210 similarly includes an adjustment tip 246. Adjustment tip 246 comprises a conical-shaped body that is threaded onto adapter 242 and includes a tapered wall 248 spaced from tapered wall 234 with a recessed portion 249 that forms a shoulder 250 adjacent and spaced inwardly from its outer end. Recessed portion 249 contacts the outer ends of the tapered wall's fingers or beams 239 and forms a ramped or cam interface with beams 239. In the illustrated embodiment, each of the beams includes a ramped surface 252, such as a wedge-shaped end, that provides a contact surface for recessed portion 249 of adjustment tip 246. In this manner, when adjustment tip 246 is rotated about coupler 242, recessed portion 249 will translate along ramped surfaces 252, which will cause fingers or beams 239 to compress inwardly when adjustment tip 246 is retracted onto coupler 242 but will allow fingers or beams 239 to expand radially outward and return to their uncompressed state when adjustment tip 246 is moved to its fully extended position, such as generally shown in FIGS. 9 and 10. In this manner, the inner diameter of the bore of passageway 216 through nozzle 210 may be adjusted by simply turning the adjustment tip about the nozzle. It should be understood that the slope angle of ramped surfaces 252 may be varied to increase or decrease the amount of adjustment in the inner diameter of tapered body portion 224. In addition, as noted in reference to the first embodiment, tip 246 may be movably mounted to nozzle body 218 with a cam/slot and pin configuration or may be slidably mounted to nozzle body 218.

To facilitate mounting of nozzle 210 to a fire hose, as noted above, nozzle 210 includes adapter 242. Adapter 242 is threaded on one end to nozzle body 218 and includes valve body 264 of valve 262 threaded therein and sealed thereto by, for example, an O-ring seal 242*a*. Valve 262 includes a pair of spaced apart valve seats 265*a* and 265*b* formed in valve body 264 and a shut-off ball 266, which is positioned between seats 265*a* and 265*b*. Ball 266 is pivotally mounted in valve body 264 on a shaft that is coupled to a handle 267. In this manner, the orientation of shut-off ball 266 may be adjusted by moving handle 267. Mounted to valve body 264 is a second adapted 268, which is threaded in body 264 and sealed therein by a seal 268*a* such as an O-ring seal. Adapter 268 is adapted for coupling to a hose coupler 270 for coupling nozzle 210 to a hose. Coupler 270 includes an annular-shaped body that inserts into adapter 268 and is sealed in adapter 268 by a seal 268*b*, such as an O-ring seal. Further, coupler 270 includes a ball race 270*a*, which provides a swivel mount for coupler 270 to adapter 268.

Valve seats 265*a* and 265*b* are respectively positioned adjacent adapters 242 and 268 so that when central passage 266*a* of shut-off ball 266 is aligned between the seats (265*a*, 265*b*), nozzle 210 is opened for flow through the nozzle, but when shut-off ball 266 is pivoted by handle 267, shut-off ball 266 will seat against seat 265*a* and close passage 216 and, thereby close nozzle 210.

Referring to FIGS. 11-14, the numeral 310 generally designates another embodiment of a hand-line nozzle. Nozzle 310 is of similar construction to nozzle 210 and includes a nozzle body 318, which is coupled to a valve 362 by a first adapter 342, which valve in turn is coupled to a second adapter 368, which incorporates a hose coupler 370 for coupling the nozzle to a hose. For further details, reference is made to the general description of nozzle 210.

In the illustrated embodiment, nozzle 310 incorporates a sleeve 341 positioned between nozzle body 318 and membrane 340. Sleeve 341 is similar to sleeve 41 and comprises a thin-flexible, but resilient sheet, for example a metal sheet, that is rolled into a conical shape with over lapping lateral edges that allow the sleeve to be compressed while retaining its conical shape, but with a smaller dimension and without creating any ripples or buckles in the sheet.

To adjust the inner diameter of tapered portion 324 of nozzle body 318, adjustment tip 346 is rotated about nozzle body 318, which will cause the fingers or beams of tapered portion 324 to compress inwardly when adjustment tip 346 is retracted onto adapter 342. The fingers or beams of tapered body portion 324 will in turn compress sleeve 341, which will retain its cylindrical shape and compress membrane 340 to reduce the inner diameter of the nozzle. Similar to the membranes of the previous embodiments, membrane 340 is installed in nozzle 310 in an unpressurized configuration. However, once fluid flow is initiated through the nozzle and the pressure in passageway 316 increases, membrane 340 will expand under the pressure of the fluid until it contacts, in this case, sleeve 341.

In this manner, when tapered body portion 324 is compressed inwardly, membrane 340 will return to a less expanded configuration, which allows membrane 340 to maintain its smooth walled configuration and, hence, smooth bore, and prevents membrane 340 from forming folds or ripples in its wall when compressed.

Figure 16:
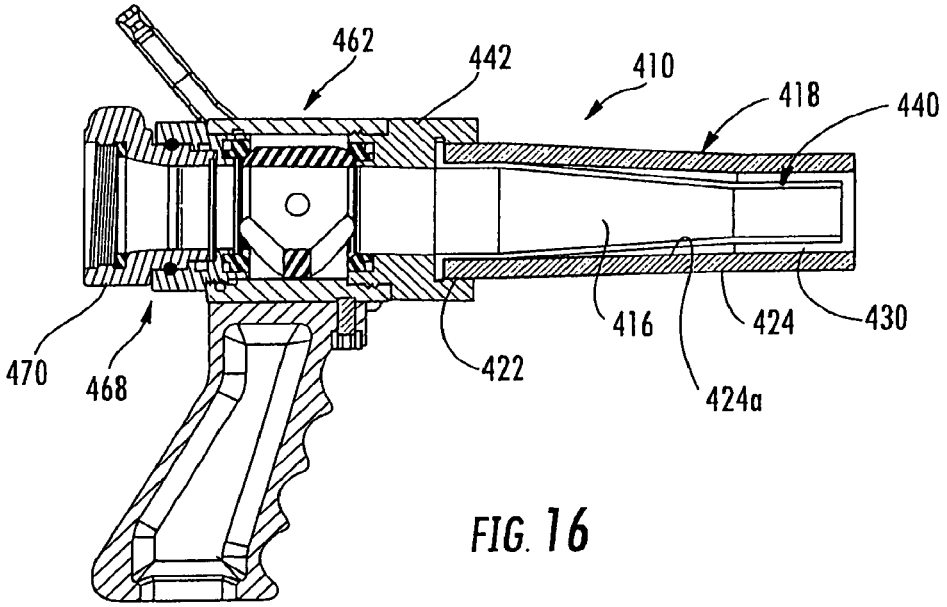
FIG. 16 is a cross-section taken along line XVI-XVI of FIG. 15.
Figure 15:
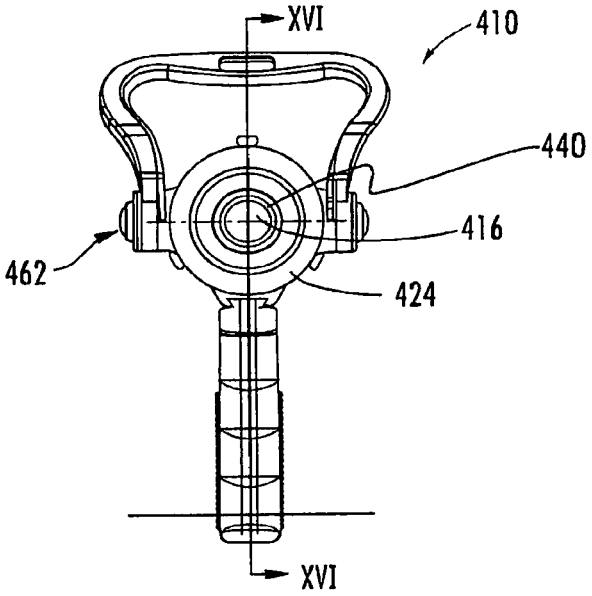
FIG. 15 is an end view of a fifth embodiment of the nozzle of the present invention.

Referring to FIGS. 15 and 16, the numeral 410 generally designates a fifth embodiment of the nozzle of the present invention. Nozzle 410 is similar to nozzles 210 and 310 and include a nozzle body 418, an adapter 442 for mounting a valve 462 to nozzle body 418, and a second adapter 468 for receiving a hose coupler for mounting nozzle 410 to a hose.

In the illustrated embodiment, nozzle body 418 includes a cylindrical body portion 422 and a tapered body portion 424, both with fixed diameters. The flexible wall in nozzle 410 is provided by membrane 440. Membrane 440 is mounted to the inlet end of cylindrical body portion 422, for example, by molding, and extends through the passage 430 of tapered body portion 424 to form flow passage 416. In this application, similar to nozzle 110, when membrane 440 is pressurized, membrane 440 will expand radially outward until it reaches the inner surface 424*a* of tapered body portion 424. For further details of nozzle 410, reference is made to the previous embodiments.

As would be understood to those skilled in the art, the present invention provides a nozzle that has a smooth bore with an adjustable inner diameter to provide an adjustable flow rate. With this increase in flexibility, the velocity of a fire hose discharge may be varied without having to replace the nozzle or having to add on to the nozzle; therefore, the adjustment can be achieved while the nozzle is still in a flowing condition.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

What is claimed is:

1. An adjustable nozzle comprising:

a longitudinal nozzle body extending from a fluid inlet to a fluid outlet, such that said nozzle body defines a central axis, said nozzle body configured to receive a pressurized fluid at said fluid inlet and discharge the pressurized fluid at said fluid outlet said nozzle body having an upstream cylindrical portion and a downstream tapered portion integrally formed with the cylindrical portion; and a flexible membrane disposed within said longitudinal nozzle body and having an upstream end proximate said cylindrical portion and in fluid communication with said fluid inlet of said nozzle body and a downstream end proximate said tapered portion and in fluid communication with said fluid outlet of said nozzle body, at least a portion of said flexible membrane having a tapered inner profile, such that a downstream portion of said flexible membrane has a smaller diameter as compared to an upstream portion of said flexible membrane when said nozzle body is devoid of the pressurized fluid, said downstream portion of said flexible membrane spaced from said nozzle body, such that said downstream portion is expandable when said nozzle body receives the pressurized fluid at said fluid inlet and is contractable when said nozzle body is devoid of the pressurized fluid.

2. The adjustable nozzle of claim 1, wherein said flexible membrane has a smooth inner surface when said nozzle body receives the pressurized fluid and when said nozzle body is devoid of the pressurized fluid.

3. The adjustable nozzle of claim 1, wherein said nozzle body further comprises a compressible wall disposed within said longitudinal nozzle body, said compressible wall defining an upstream portion and a downstream portion and positioned radially exterior of said flexible membrane and radially interior of said nozzle body.

4. The adjustable nozzle of claim 3, wherein said compressible wall defines a bore having an upstream bore diameter at said upstream portion and a downstream bore diameter at said downstream portion, said downstream bore diameter substantially equal to said upstream bore diameter, whereby said bore is substantially cylindrical.

5. The adjustable nozzle of claim 4, wherein said flexible membrane bears against said bore when said nozzle body receives the pressurized fluid, such that an outer diameter of said flexible membrane and an inner diameter of said compressible wall are substantially equal.

6. The adjustable nozzle of claim 3, wherein said nozzle body further comprises a rolled sleeve positioned radially exterior of said flexible membrane and radially interior of said compressible wall, said flexible membrane expanding to contact said rolled sleeve when said nozzle body receives the pressurized fluid.

7. The adjustable nozzle of claim 6, wherein said compressible wall comprises a plurality of fingers deflectable to contact at least a portion of said flexible membrane when said nozzle body receives the pressurized fluid, said fingers defining a plurality of gaps between one another, and said rolled sleeve operable to prevent said flexible membrane from extruding into said gaps when said nozzle body receives the pressurized fluid.

8. The adjustable nozzle of claim 7, further comprising a tip slidably mounted to said nozzle body, said tip axially adjustable to selectively deflect said fingers as said tip is axially adjusted along said longitudinal nozzle body.

9. An adjustable nozzle comprising:

a nozzle body having a fluid passageway extending from a fluid inlet to a fluid outlet, such that said nozzle body defines a longitudinal axis, said nozzle body configured to receive a pressurized fluid at said fluid inlet and discharge the pressurized fluid at said fluid outlet;

a flexible membrane disposed within said nozzle body and having an upstream end in fluid communication with said fluid inlet of said nozzle body and a downstream end in fluid communication with said fluid outlet of said nozzle body; and a rolled sleeve positioned radially outside of said flexible membrane such that said flexible membrane is at least partially disposed within said rolled sleeve, said rolled sleeve formed from a triangular-shaped sheet that is rolled into a conical shape with overlapping longitudinal edges, and at least a portion of said flexible membrane having a tapered inner profile, such that a downstream portion of said flexible membrane has a smaller diameter as compared to an upstream portion of said flexible membrane when said nozzle body is devoid of the pressurized fluid.

10. The adjustable nozzle of claim 9, wherein said nozzle body further comprises a compressible wall disposed radially exterior of said rolled sleeve, such that said rolled sleeve is disposed between said flexible membrane and said compressible wall.

11. The adjustable nozzle of claim 10, wherein said compressible wall comprises at least one gap, said rolled sleeve preventing said flexible membrane from extruding into said at least one gap when said flexible membrane is urged into contact with said rolled sleeve by the pressurized fluid.

12. The adjustable nozzle of claim 11, wherein said compressible wall comprises one or more bendable fingers.

13. The adjustable nozzle of claim 12, wherein said one or more bendable fingers are inwardly deflectable to constrain said flexible membrane when said nozzle body receives the pressurized fluid.

14. The adjustable nozzle of claim 13, further comprising a tip mounted to said nozzle body and axially slidable along said longitudinal axis, said tip positioned to deflect said one or more bendable fingers radially inwardly when said tip is slid in an upstream direction along said longitudinal axis and to permit said one or more bendable fingers to expand radially outwardly when said tip is slid in a downstream direction along said longitudinal axis.

15. The adjustable nozzle of claim 9, wherein said flexible membrane comprises a rubber membrane.

16. An adjustable nozzle comprising:

a longitudinal nozzle body extending from a fluid inlet to a fluid outlet, such that said nozzle body defines a longitudinal axis, said nozzle body configured to receive a pressurized fluid at said fluid inlet and discharge the pressurized fluid at said fluid outlet;

a flexible membrane disposed within said nozzle body and having an upstream end in fluid communication with said fluid inlet of said nozzle body and a downstream end in fluid communication with said fluid outlet of said nozzle body, at least a portion of said flexible membrane having a tapered inner profile, such that a downstream portion of said flexible membrane has a smaller diameter as compared to an upstream portion of said flexible membrane when said nozzle body is devoid of the pressurized fluid; and a compressible wall disposed within said nozzle body radially outside of said flexible membrane, said compressible wall having an upstream portion defining an upstream inner diameter and a downstream portion defining a downstream inner diameter, said upstream and downstream inner diameters equal to one another, such that said compressible wall is non-tapered.

17. The adjustable nozzle of claim 16, wherein said flexible membrane contacts said downstream inner diameter of said compressible wall when said nozzle body receives the pressurized fluid.

18. The adjustable nozzle of claim 16, wherein said flexible membrane has a smooth inner surface both when said nozzle body is devoid of the pressurized fluid and when said nozzle body receives the pressurized fluid.

19. The adjustable nozzle of claim 16, wherein said compressible wall comprises a plurality of deflectable beams.

20. The adjustable nozzle of claim 19, wherein said nozzle body further comprises a tip mounted to said nozzle body and axially movable along the longitudinal axis, said tip adjustable to deflect said beams of said compressible wall when said tip is axially moved.

* * * * *